United States Patent [19]

Kuo

[11] Patent Number: 4,787,765

[45] **Date of Patent: * Nov. 29, 1988**

[54] DENTIFRICE DISPENSING TOOTHBRUSH

[76] Inventor: Youti Kuo, 88 Foxbourne Rd., Penfield, N.Y. 14526

[ * ] Notice: The portion of the term of this patent subsequent to Sep. 22, 2004 has been disclaimed.

[21] Appl. No.: 94,938

[22] Filed: Sep. 10, 1987

Related U.S. Application Data

[63] Continuation-in-part of Ser. No. 830,467, Feb. 18, 1986, Pat. No. 4,695,177.

[51] Int. Cl.[4] ..... A46B 11/02

[52] U.S. Cl. ..... 401/191; 401/84; 401/135; 401/141; 401/146; 401/150; 132/311

[58] Field of Search ..... 401/84, 135, 141, 146, 401/150, 176, 191, 175; 132/84 R, 84 B, 84 D

[56] References Cited

U.S. PATENT DOCUMENTS

| | | | |
|---|---|---|---|
| 965,309 | 7/1910 | MacDonald | 132/84 B |
| 1,859,108 | 5/1932 | Nadoolman | 401/191 |
| 2,000,910 | 5/1935 | Appel et al. | 401/176 |
| 2,328,048 | 8/1943 | Bair | 401/150 |
| 4,467,822 | 8/1984 | Blackwell | 401/175 X |
| 4,692,047 | 9/1987 | Endo | 401/141 X |
| 4,695,177 | 9/1987 | Kuo | 401/150 |
| 4,733,983 | 3/1988 | Hertrampf | 401/176 X |

*Primary Examiner*—Richard J. Apley

*Assistant Examiner*—Franklin L. Gubernick

*Attorney, Agent, or Firm*—Fred L. Denson

[57] ABSTRACT

A dentifrice dispensing toothbrush is described which stores dentifrice material in its handle and deposits a controlled quantity of the stored material directly onto the top of the brush surface. The toothbrush comprises (1) a housing which includes a handle, (2) a reservoir situated within the housing for storing dentifrice material, (3) a brush having bristles which are attached to and supported by a brush head member, and (4) a pump which causes a controlled quantity of dentifrice material to be pumped from the reservoir through a channel and a movable applicator and thereafter, to be deposited onto the brush surface. The applicator can be positioned in either a depositing or non-depositing relationship with the brush surface. No dentifrice can be pumped from the reservoir when the applicator is in a non-depositing relationship with the brush surface thus preventing the accidental discharge of dentifrice.

The toothbrush is operated by depressing the brush member which causes dentifrice material to be pumped from the reservoir. This is coupled with a simultaneous action of extending the applicator to dispense a controlled portion of dentifrice material directly onto the top surface of the brush. The toothbrush can be conveniently and efficiently operated with one hand. Its features make it particularly suitable for use by the physically handicapped.

10 Claims, 9 Drawing Sheets

DENTIFRICE DISPENSING TOOTHBRUSH

CROSS REFERENCE TO RELATED APPLICATION

This application is a continuation-in-part of copending application Ser. No. 830,467 filed Feb. 18, 1986 by Youti Kuo, and now U.S. Pat. No. 4,695,177 issued Sept. 22, 1987.

BACKGROUND OF THE INVENTION

1. Field of the Invention

The present invention relates to a toothbrush which has a reservoir for storing dentifrice material. More particularly, the invention relates to a toothbrush wherein the stored dentifrice material is conveniently applied directly onto the top surface of the brush.

2. Description of the Prior Art

There are a variety of toothbrushes in the prior art which store and dispense dentifrice material from the handle of the brush. Most of these brushes dispense the dentifrice material at the base of the brush where the bristles are attached to the brush head support. Typical patents which utilize this method for feeding dentifrice material to the brush include U.S. Pat. Nos. 4,221,492, 4,116,570 and 4,201,490. Bottom fed brushes tend to use excessive dentifrice material since the material must be forced through the bristles to reach the surface where it is useful. Moreover, such brushes are more difficult to clean since unused dentifrice material has a tendency to become clogged at the base of the bristles. This is hygienically undesirable.

Other prior art patents have recognized the shortcomings of bottom fed brushes. These patentees have attempted to overcome the problem by designing brushes which do not feed dentifrice material from the bottom. U.S. Pat. No. 4,039,261 discloses a brush having a series of specially designed hollow bristles. Dentifrice material is forced through the bristles and deposited on the top brush surface. Because conventional bristles are not used, the increased cost of the brush is a significant factor. Moreover, because there is no way to seal off the interior of the bristles when they are not in use, hygiene is also a factor. U.S. Pat. No. 3,879,139 describes a chimney made from bristles to facilitate movement of dentifrice material to the brush surface. This structure is inherently inefficient since dentifrice material is discharged at or near the bottom of the bristle chimney. U.S. Pat. No. 3,256,894 discloses a brush which includes a fountain-like applicator which is positioned immediately below the brush surface. Dentifrice material is fed to the applicator from the bottom, but is deposited on or near the brush surface. The disadvantage of this structure is realized when the brush is in use; when pressure is applied, the applicator contacts the users teeth and gums causing potential discomfort.

Many of the brushes described in the reference prior art require the use of two hands to conveniently and efficiently dispense dentifrice material onto the brush. The brush described in U.S. Pat. No. 4,221,492 can ostensibly be operated with one hand, but not without extreme difficulty. The handle which contains the dentifrice material is flexible on one side and rigid on the other side. The flexible side of the handle is manipulated to force dentifrice material from the handle to the brush while the rigid side of the handle is used to apply force while brushing. A high level of skill and dexterity are required while brushing to prevent additional dentifrice material from being squeezed from the handle. Thus, the user is required to apply pressure to the handle during brushing while at the same time exercising care not to simultaneously squeeze the handle which could cause more dentifrice material to be forced out of the handle.

U.S. Pat. No. 2,986,766 discloses a fountain toothbrush having a reservoir in the brush handle for receiving a replaceable cartridge of dentifrice material. While the patentee recognizes the advantage of an applicator which places dentifrice material directly onto the top surface of a brush, the applicator and pump are cumbersome and require the use of both hands for operation. The operation of the pump is not automatic in that the dentifrice material is transported by a screw which requires turning by one hand while use of the other hand is required to hold the body of the brush. In addition, the brush can become messy during operation since the applicator grooves can become clogged with dentifrice material. The inconvenience of operation and the cumbersome structure detract from the other advantages associated with the brush.

U.S. Pat. No. 3,613,698 describes a toothbrush wherein dentifrice material is deposited directly onto the top surface of the brush. The disadvantages of the device described in the patent are that it requires a specially designed cartridge, it includes an array of flapper and ball check valves in the cartridge and the housing which lend to operating inefficiency and it cannot be conveniently operated with one hand. Delivery of the dentifrice material from the cartridge to the brush involves a two stage operation requiring the use of two hands. In the first stage, the user must hold the housing with one hand while pulling an end cap back with the other hand in order to pump dentifrice material from the cartridge. In the second stage, the user must push the end cap forward with one hand while securing the housing in place with the other hand in order to deposit the dentifrice material onto the brush surface.

There are no brushes described in the referenced art which are specifically designed for those who have use of only one hand such as those who are physically handicapped or are otherwise disabled. During the past several yars, a growing number of people who have been afflicted with varying types of developmental disabilities, have been relocated from institutions to community residences or group homes. Most residences of this type have few staff to assist the handicapped residents with their daily hygenic activities such as teeth brushing. Thus, there is a clearly defined need for a toothbrush that can be readied for use and manipulated by people of limited dexterity.

SUMMARY OF THE INVENTION

In accordance with the present invention, a dentifrice dispensing toothbrush is provided which stores dentifrice material and deposits a controlled quantity of the stored material directly onto the top of the brush surface. The toothbrush of the present invention comprises (1) a housing which includes a handle, (2) a reservoir situated within the housing for storing dentifrice material, (3) a brush having bristles which are attached to and supported by a brush head member, and (4) a pumping means which causes a controlled quantity of dentifrice material to be pumped from the reservoir through a channel and a movable applicator and thereafter, to be deposited onto the surface of the brush. The channel is situated within the housing and has two openings. One of the openings is in communication with the pumping means while the remaining opening is in communication with the movable applicator. The movable applicator is a tube which has two openings. The applicator can be positioned so that it is in a depositing relationship with the brush surface. When the applicator is in this position, one of its openings is aligned with an opening in the channel to permit dentifrice material to be pumped from the reservoir, through the channel and the applicator and to be deposited directly onto the brush surface as it is discharged from the second opening in the applicator's sidewall. The applicator can also be positioned so that it is in a non-depositing relationship with the surface of the brush. When the applicator is in this position, the openings in the applicator and the channel are not aligned thereby preventing any dentifrice material from being pumped from the reservoir or discharged from the applicator. This arrangement is particularly advantageous since it precludes the possibility of the accidental discharge of dentifrice material should the pumping means be inadvertently activated.

The dentifrice material is stored either directly in the reservoir or in a removable cartridge which is inserted in the reservoir. The cartridge comprises a hollow cylinder and a disc which has the same shape as the cylinder base. The disc is slidably mounted within the cylinder and its purpose is to prevent backflow of dentifrice material when a pumping force is applied to the cartridge. In one embodiment, the cylinder contains grooves on its inner wall surface while the disc contains a plurality of flexible, radially extending fingers positioned along its circumference. The maximum dimension of the disc including its flexible, radially extending fingers is greater than the maximum internal cross sectional dimension of the cylinder so that the ends of the flexible, radially extending fingers are mated in the grooves. The angle and positioning of the finger tips in the grooves limit movement of the disc to one direction only.

The toothbrush of this invention is operated by depressed the brush member which causes dentifrice material to be pumped from the reservoir. This is coupled with a simultaneous action of extending the applicator to dispense a controlled quantity of dentifrice material directly onto the top surface of the brush. The toothbrush described herein can be conveniently and efficiently operated with one hand. In this regard, the structure permits the user to supply dentifrice material to a brush and for the user to brush his or her teeth with the use of one hand. This is of particular significance to physically handicapped persons and to persons having a limited degree of manual dexterity. Because the quantity and flow of dentifrice material are controlled, it is unnecessary to rely on vision when it is applied to the brush. Thus, the invention is also advantageous to the visually impaired. Additionally, the toothbrush of this invention is conveniently transported and saves space since the toothbrush and dentifrice material are combined in one structure. The means of applying dentifrice material to the top surface of the brush enables conventional means for cleaning the brush. Moreover, hygiene is promoted since the use of dentifrice material is personalized.

The invention and its objects and advantages will become more apparent by referring to the accompanying drawings and to the ensuing detailed description of the preferred embodiment.

BRIEF DESCRIPTION OF THE DRAWINGS

FIG. 6A shows the brush in its fully extended position and the applicator in its fully retracted position before any dentifrice material is applied to the brush surface. FIG. 6B shows the brush in a partially retracted position and the applicator in a partially extended position prior to dispensing dentifrice material. FIG. 6C shows the brush in its fully retracted position and the applicator in its fully extended position upon completion of the depositing of dentifrice material onto the brush surface.

DETAILED DESCRIPTION OF THE PREFERRED EMBODIMENTS

Figure 1:
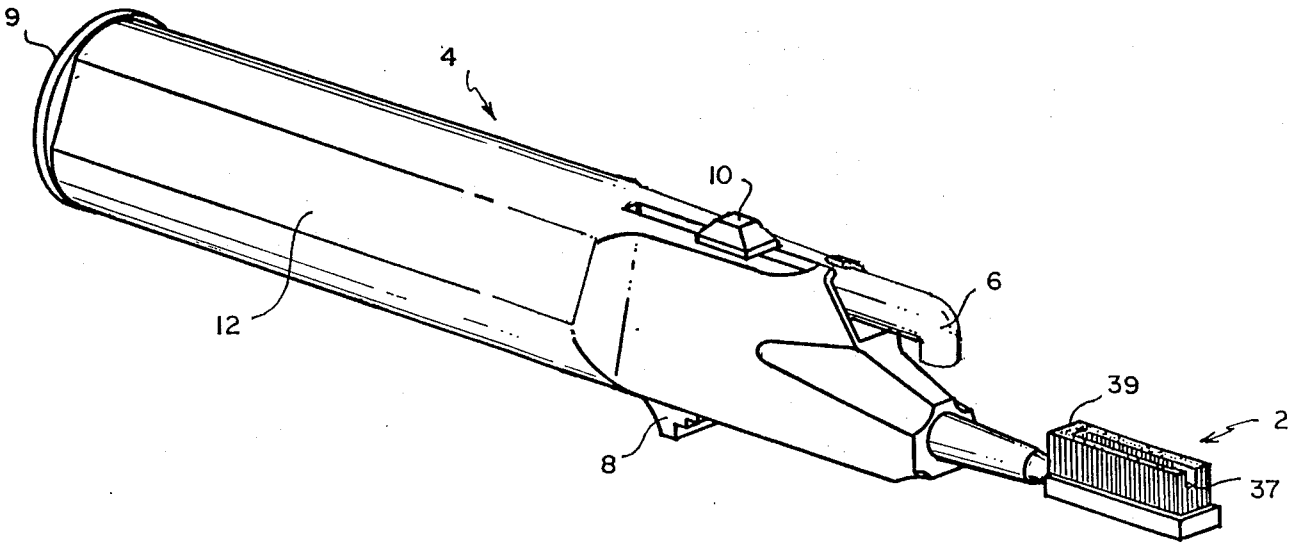
FIG. 1 is a perspective view of a dentifrice dispensing toothbrush according to this invention.

As shown in FIG. 1, the dentifrice dispensing toothbrush of the invention includes brush 2, housing 4 which includes a handle portion and base 9. Tubular shaped applicator 6 with applicator handle 10 is slidably attached to housing 4. Included within housing 4 is reservoir 12 which is used for storing dentifrice material. Pump or plunger handle 8 is used to pump dentifrice material from reservoir to 12 to applicator 6 and subsequently onto the top surface of brush 2.

The dentifrice material is either stored directly in reservoir 12 or, in accordance with a preferred embodiment, is stored in a removable cartridge. The removable cartridge can be of any shape so long as its shape is compatible with the shape of reservoir 12. As shown in FIGS. 3A, 3B, 3C and 3D, removable cartridge 52 is a hollow cylinder with wall 54 and flanged base 9 on one end which also serves as the base for housing 4. A slidable disc 58 is mounted in the flanged end of cartridge 52 to prevent backflow and leakage of dentifrice material when a pumping force is applied to the cartridge. The center part 61 of disc 58 has a shape which is conformable to cylinder base 9. Backflow and leakage of dentifrice material is prevented by annular lip 59 of disc 58. The width of lip 59 is slightly larger than the internal width of the cartridge. Lip 59 is made from a flexible material so as to provide a snug fit when disc 58 is inserted in cartridge 52 and to enhance its sealing capability.

Cartridge 52 also has a flexibly flared end 51 on its other end. A pair of oppositely disposed retention tabs 53 are situated on the inner wall surface of the cartridge at flared end 51. The external width of the cartridge at its flexibly flared end 51 is slightly greater than the internal width of the reservoir. Flexibly flared end 51 thereby provides a seal to prevent dentifrice material from leaking from the cartridge when it is under a pumping force. The distance between the oppositely disposed retention tabs 53 is less than the width of disc 58 to prevent movement of the disc beyond the tabs. This arrangement ensures that disc 58 and cartridge 52 are removed from the reservoir together when the cartridge is replaced.

As dentifrice material is pumped from cartridge 52, disc 58 slides from the flanged end toward the open end of the cartridge. Backward movement, i.e. movement of the disc toward the flanged base 9 of the cartridge 52, is prevented by a plurality of flexible, radially extending fingers 60 which are positioned on the circumference of disc 58. The maximum width of the disc including the fingers is greater than the internal width of cartridge 52. Thus, when disc 58 is positioned in cartridge 52, the tips of fingers 60 contact the inner wall of cartridge 52. The stubbing force resulting from the contact prevents the backward movement of disc 58. In a preferred embodiment, the inner surface of wall 54 contains a series of grooves 56 having an angular pitch which enhances the uni-directional movement of disc 58. Backward movement of disc 58 is further prevented when the tips of fingers 60 are mated in position with grooves 56 as shown at 62 of FIG. 3C.

Cartridge 52 containing dentifrice material is inserted in reservoir 12. Disc 58 seals the bottom end of cartridge 52 and ensures that dentifrice material flows only from the open end 48 of cartridge 52. Cartridge 52 is removable. Thus, when all the dentifrice material is used, the empty cartridge is removed and replaced with a full cartridge which is inserted into reservoir 12.

Figure 2A:
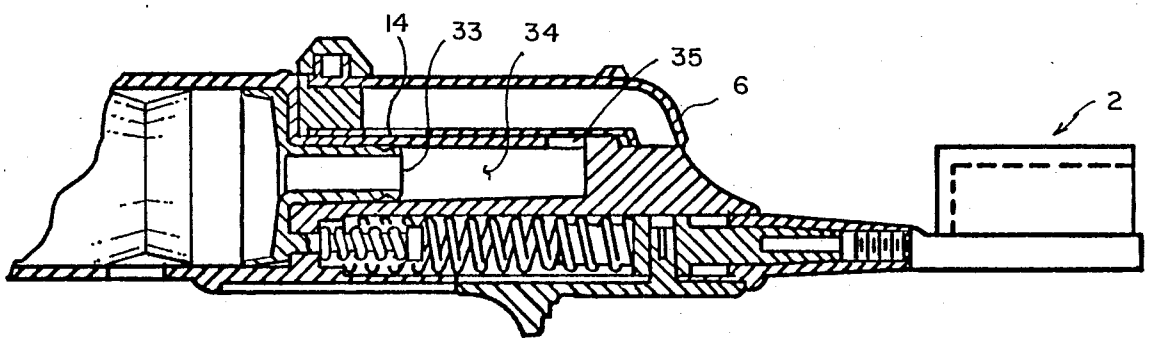
FIGS. 2A and 2B are front elevational views with partial sectional views of the toothbrush shown in FIG. 1.
Figure 2B:
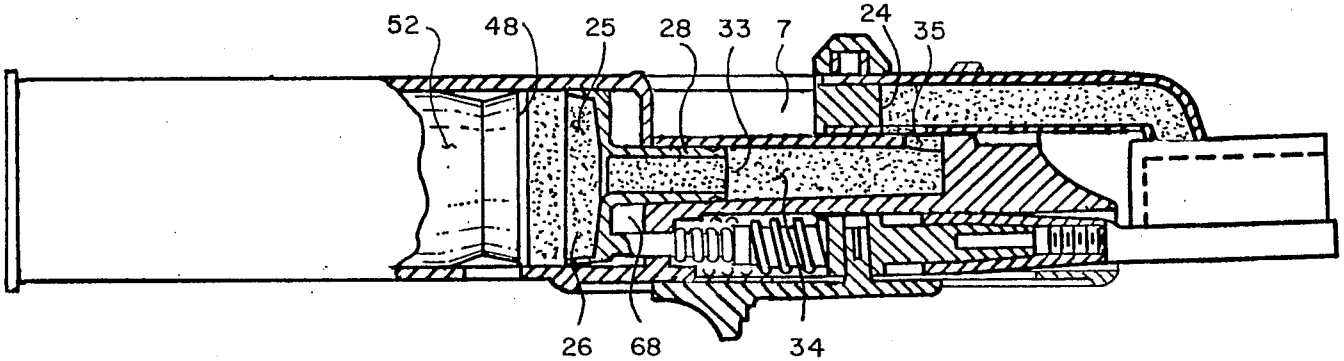
Figure 3A:
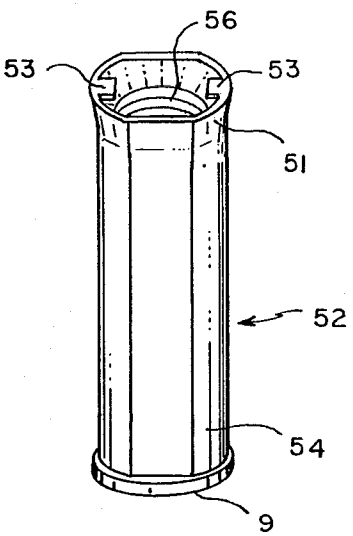
FIG. 3A is a perspective view of a cartridge which is inserted in the housing of the toothbrush of FIGS. 1, 2A and 2B.
Figure 3B:
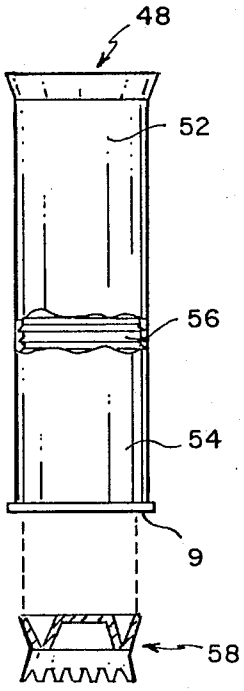
FIG. 3B is a cut away pictorial view of the cartridge of FIG. 3A and a disc which is used with the cartridge.
Figure 3D:
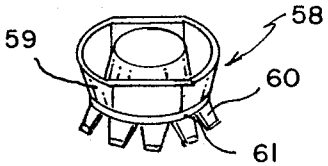
FIG. 3D is a perspective view of the disc.
Figure 3C:
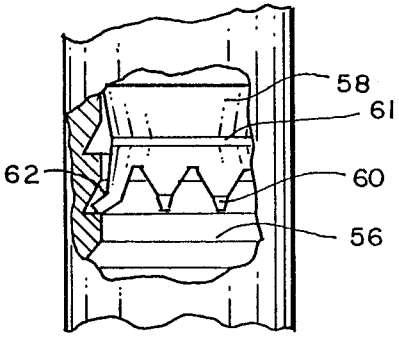
FIG. 3C is a partial sectional view of the cartride of FIG. 3A with the disc inserted in the cartridge.
Figure 4A:
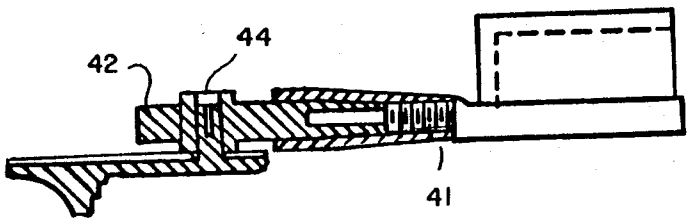
FIG. 4A is an orthographic view of the brush assembly of the dentifrice dispensing toothbrush of this invention.
Figure 4B:
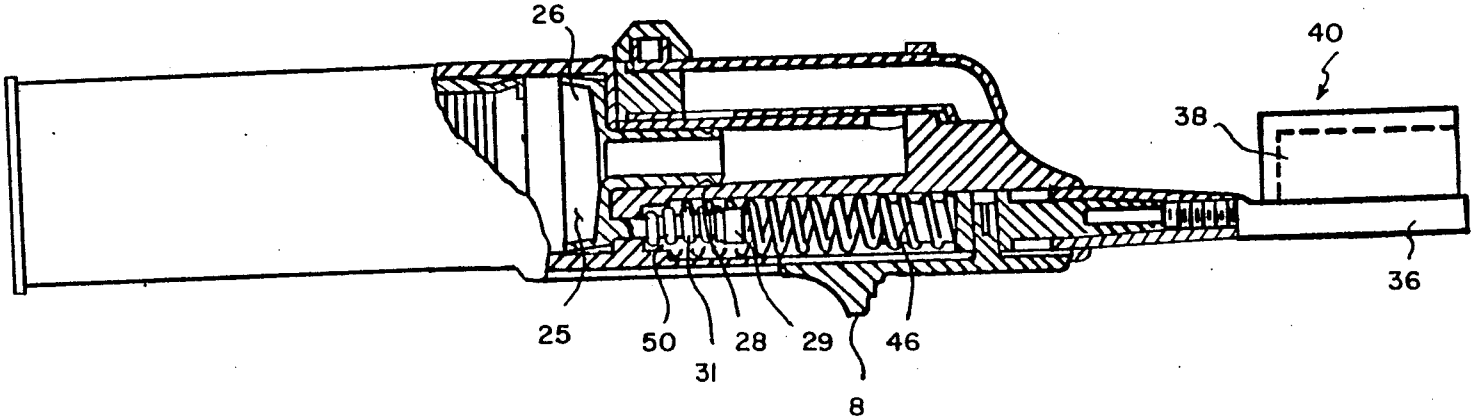
FIG. 4B is an orthographic view of the brush assembly of FIG. 4A with a partial cut away to show the brush assembly inserted in the housing.
Figure 5B:
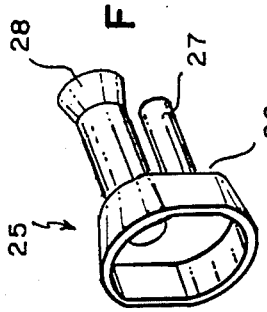
FIGS. 5B and 5D are perspective views of the piston which is positioned within the housing of FIG. 5A.
Figure 5D:
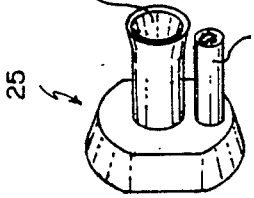
Figure 5C:
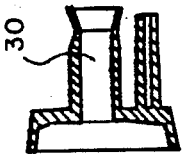
FIG. 5C is a front sectional view of the piston of FIG. 5B.
Figure 5E:
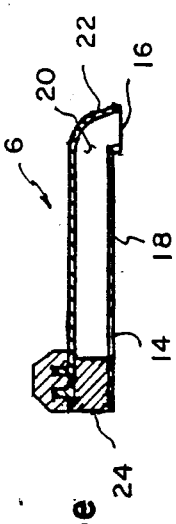
FIG. 5E is a sectional view of the applicator.

Referring to FIGS. 2A, 2B and 4B, piston 25 is positioned at the output end of reservoir 12. The head 26 of piston 25 is also adjacent to open end 48 of cartidge 52. The stem 28 of piston 25 is positioned in channel 34. As shown in FIGS. 5B, 5C and 5D, piston 25 contains piston head 26 and piston stem 28. Orifice 30 comprises an annular opening which extends longitudinally through piston head 26 and piston stem 28. Piston head 26 is preferably concave in shape to facilitate the flow of dentifrice material from cartridge 52 through orifice 30 to channel 34. Piston drive rod 27 is part of piston 25 and is on the chamber side of the piston for transmitting a pumping force from pump handle 8 to piston head 26.

Housing 4 is made of a moldable material. Thermoplastic resins are particularly suitable since they can be readily shaped using conventional molding techniques. Thus, housing 4 is molded to provide a wall for reservoir 12, a wall for channel 34, plunger well 66 and a recess 7 for applicator 6. Channel 34 includes a first opening or inlet 33 and a second opening or outlet 35. Inlet 33 is in communication with orifice 30 while outlet 35 is in communication with applicator 6 as shown in FIGS. 2A and 2B.

Figure 5A:
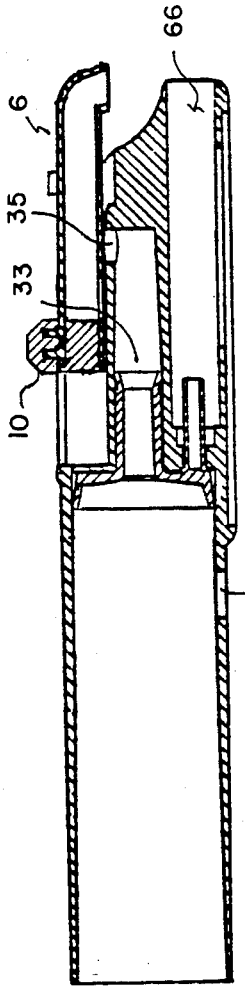
FIG. 5A is a front sectional view of the housing showing a piston positioned therein.

Applicator 6 is shown in FIGS. 5A and 2B as being mounted in recess 7 provided in housing 4. It is comprised of a tube having a closed end 24, an inlet or first opening 14 in the side wall 18 of the tube and an outlet or second opening 16 at the remaining end or in side wall 18 near the remaining end (not shown). Bend 22 facilitates flow of dentifrice material through the applicator and onto the brush surface. The closed end 24 includes a solid portion which is of sufficient length to block the flow of dentifrice material into recess 7 when the applicator is in a fully extended dispensing position. It also prevents dentifrice material from becoming lodged in space which is not in the path of flow of the dentifrice material.

Applicator 6 is movable from a retracted position as shown in FIG. 2A to a fully extended position as shown in FIG. 2B. When fully extended, the applicator is in a depositing relationship with the surface of brush 2. In this position the second opening 16 of the applicator is immediately over the surface of brush 2 enabling dentifrice material to be deposited directly onto the surface; the first opening 14 is aligned with the second opening 35 of the channel 34 to permit dentifrice material to flow from channel 34 to the applicator. When the applicator is not sufficiently extended, the applicator is not in a depositing relationship with the surface of brush 2. No dentifrice material can be pumped through the applicator and deposited on the surface of brush 2 because the first opening 14 of the applicator and the second opening 35 of the channel are not aligned. The non-alignment of these openings blocks the flow path of the dentifrice material. The applicator is normally stored in its fully retracted position when not in use. When in this position, it is in a non-depositing relationship with the brush surface and no dentifrice material can flow through it. This position prevents leakage of dentifrice material if the pumping means is inadvertently activated. Applicator handle 10 assists the user in extending or retracting applicator 6.

Figure 8:
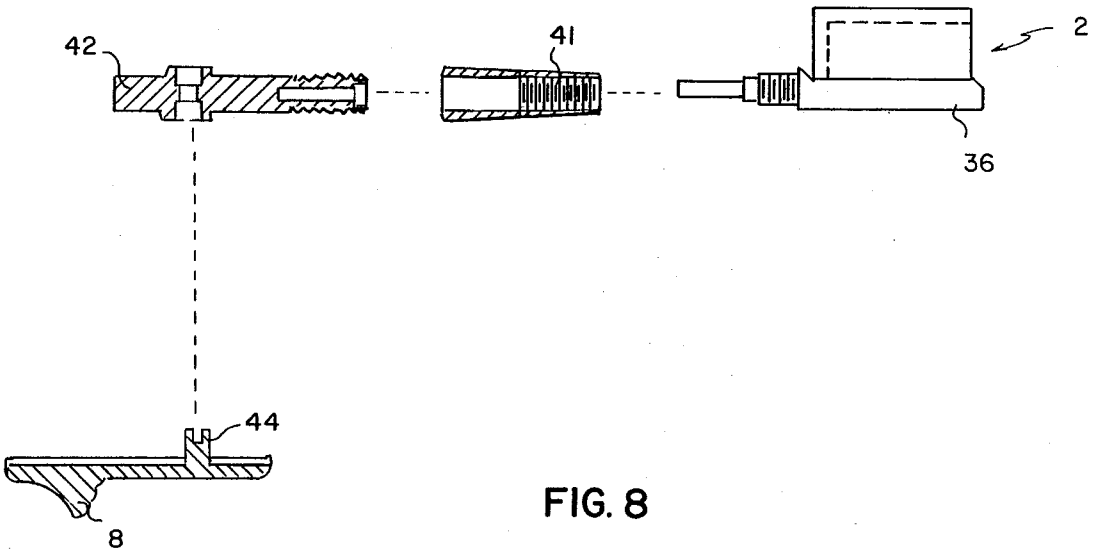
FIG. 8 is an orthographic view of the individual parts of the brush assembly of FIG. 4A.

The brush and plunger assembly is shown in FIGS. 4A, 4B and 8. Brush 2 includes a set of bristles 38. The bottom end portions of the bristles are attached to brush head support 36. The top end portions are unattached and collectively provide a surface 40 for supporting dentifrice material. Brush head support 36 is attached to the assembly by any suitable means. A threaded coupling 41 is particularly advantageous since this arrangement permits the brush head to be easily replaced when necessary. Moreover, it provides a secure attachment to prevent rotation of the brush and also to prevent the brush head from becoming detached from the rest of the assembly while in use. The brush and plunger assembly also includes plunger 42 and means for releasably attaching the assembly to housing 4. A fastener such as 44 and a corresponding member (not shown) in the housing are particularly suitable for retaining the assembly in position in well 66 (FIG. 5A). When inserted in well 66, plunger 42, plunger spring 46 and plunger spring support 50 provide a means for applying a pumping force to dentifrice material stored in reservoir 12.

A pulling force is initially applied to plunger 42 by a force applied to plunger handle 8, which pulls the brush closer to applicator 6. When a force is further applied to handle 8, spring 46 is compressed and plunger 42 contacts piston drive rod 27 causing piston head 26 to move toward base 9. As piston head 26 moves toward base 9, a partial vacuum is created in pump chamber 68 as shown in FIG. 2. The pumping force is transmitted to the dentifrice material 64 contained in cartridge 52. Because no backflow is possible, the dentifrice material 64, under increased pressure, is caused to flow from cartridge 52 through orifice 30 and into channel 34. When outlet 35 of channel 34 is aligned with applicator 14, dentifrice material is forced into applicator 6. Simultaneously, a controlled portion of dentifrice material flows from applicator outlet 16 and is depositioned onto the top of brush surface 40.

When the force applied to handle 8 is released, plunger 42 is caused to return to its original position by the reaction force of spring 46. The partial vacuum previously created in pump chamber 68 causes piston 25 to return to its original position. Spring 31 attached to piston drive rod extension 29 situated at the base of plunger well 66 facilitates return of piston 25 to its original position. Piston drive rod extension 29 is connected to piston drive rod 27. At the same time, a pressure lower than atmospheric pressure is thus created on the cartridge side of piston 25 which causes a volume of dentifrice material which is equivalent to the volume of the pump chamber to advance with piston head 26 and to occupy the space previously created as pump chamber 68. As dentifrice material moves toward piston 25, disc 58 is also simultaneously moved in the same direction due to the pressure difference. As previously explained, the movement of disc 58 is uni-directional because of the locking action provided by the positioning of fingers 60 into grooves 56 in wall 54 of cartridge 52. The volume of pump chamber 68 corresponds to the quantity of dentifrice material deposited on the surface of the brush during one application. This controlled quantity ensures that excessive dentifrice is not used thereby minimizing waste and enhancing efficiency.

The bristles comprising brush surface 40 can be arranged in any of the standard configurations known in the art. It is preferred that bristles 39, on the perimeter of the brush head, be slightly longer than the bristles located near the center of the brush surface except along the perimeter farthest from the handle. As described below, elongated bristles 39 clean excess dentifrice material from the applicator outlet 16 when the applicator is retracted. A U-shaped bristle configuration as shown in FIG. 1 is particularly suitable. In this arrangement, shortened bristles 37 are situated near the center and at the forward end of the brush surface farthest from the handle. The elongated bristles 39 are situated along the remaining perimeter of the brush surface.

Figure 6A:
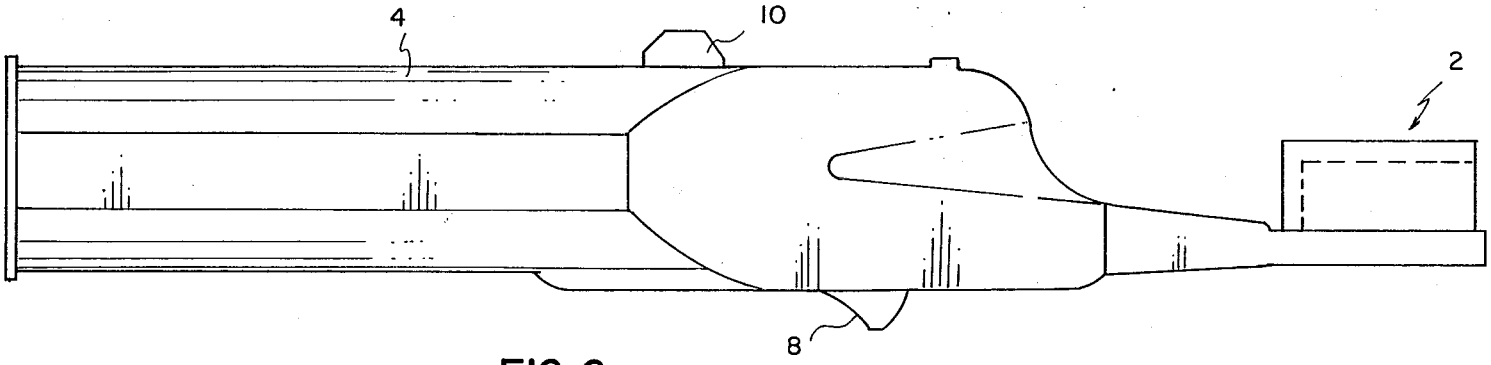
FIGS. 6A, 6B and 6C are plan views which show the relationship of the parts of the toothbrush when dentifrice material is applied to the brush surface.
Figure 6B:
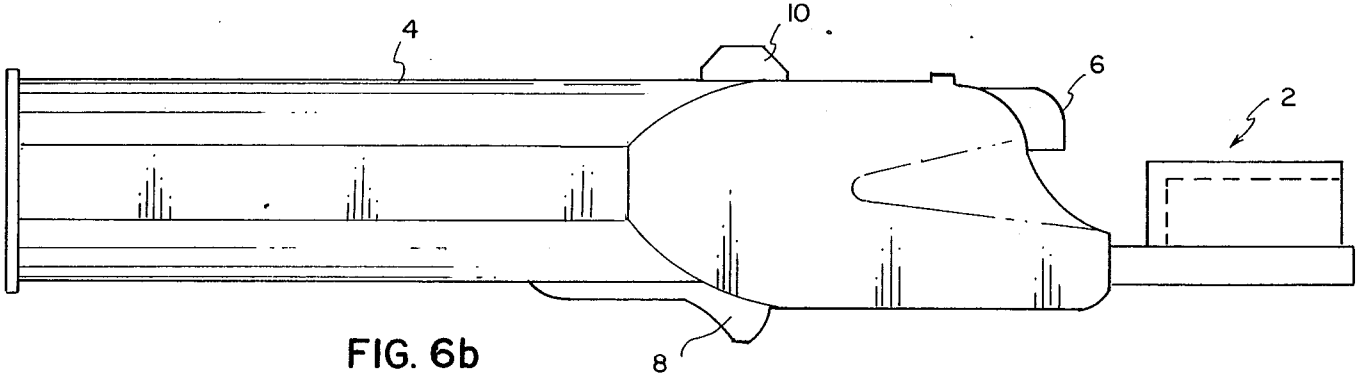
Figure 6C:
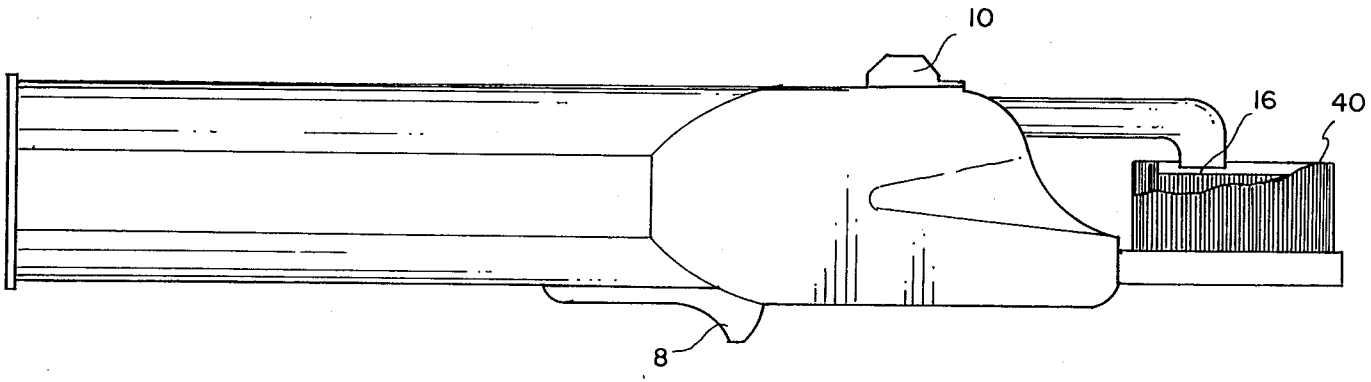
Figure 7:
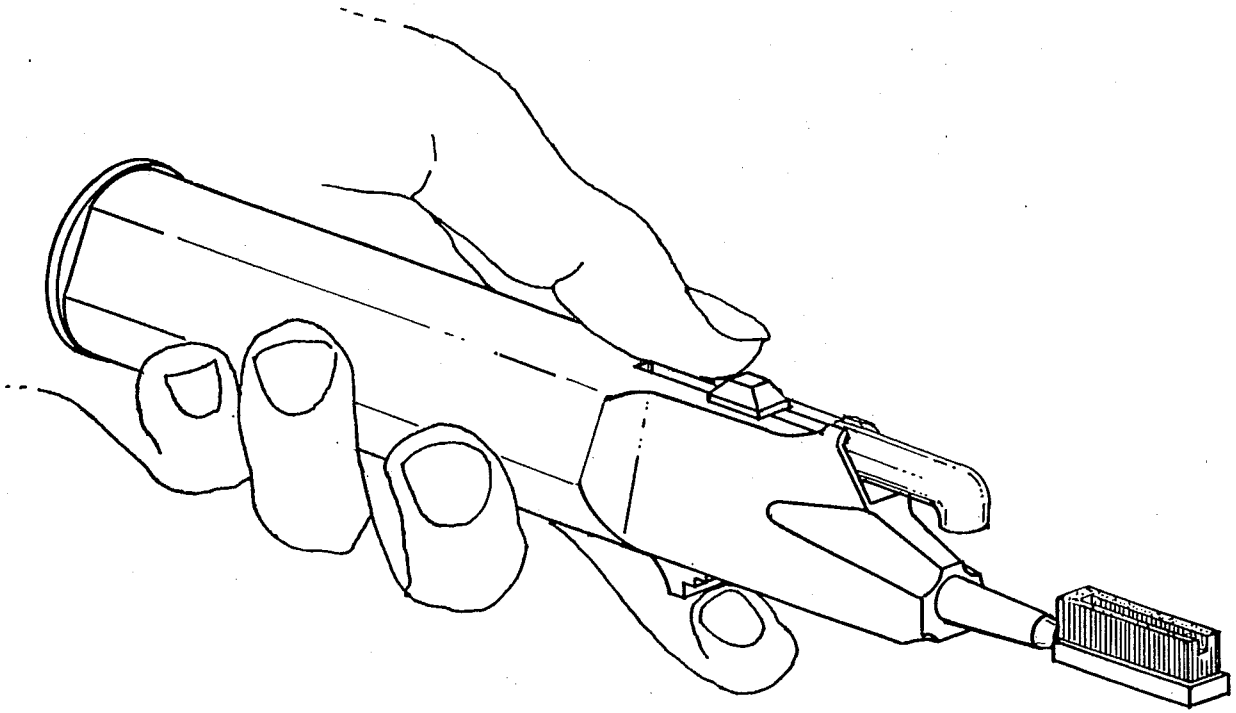
FIG. 7 is a perspective view of the toothbrush positioned in the hand of a user.

The operation of the dentifrice dispensing toothbrush of this invention is demonstrated in FIGS. 6A, 6B and 6C. While the user is holding the device by the handle part of housing 4 with one hand, the user's thumb and index finger are simultaneously used to apply opposite forces to plunger handle 8 and applicator handle 10. The forces applied by the thumb and index finger cause brush 2 and applicator 6 to move towards each other. As brush surface 40 passes directly under applicator outlet 16, a controlled portion of dentifrice material is deposited directly onto the top of brush surface 40. The alignment of applicator outlet 16 and brush surface 40 are such that dentifrice material is deposited over a controlled length on the brush surface. After the application is completed, the index finger and thumb apply opposite forces to handles 8 and 10 causing the applicator to become retracted and the brush to become fully extended and ready for use. Elongated bristles 39 at the handle end of brush 2 clean excess dentifrice material 64 from applicator outlet 16 as the applicator is retracted. After each use is completed, brush 2 is readily cleaned with water and the brush is ready for reuse. When applicator 6 is returned to its original position, outlet 16 becomes closed which also seals the dentifrice material contained on the device from the atmosphere. It is therefore prevented from caking or drying out when not in use.

Each of the parts which are in the path of flow of the dentifrice material are sealed so as to prevent unwanted leakage. The design of disc 58 prevents leakage when dentifrice material is pumped from cartridge 52. Piston 25, plunger 42, applicator 6 and the housing 4 are interpositioned so as to provide enhanced flow and to provide seals against leakage of dentifrice material.

Port 5 is provided in housing 4 for viewing the dentifrice material 64 in cartridge 52. This serves to alert the user as to when the cartridge is nearing an empty state and in need of replacement before it is completely empty. Port 5 also allows trapped air to be vented from the housing when the cartridge is inserted in the housing.

The advantages of the dentifrice dispensing toothbrush of the invention are readily apparent from the foregoing description. Its storage space is minimized since it is storable in an upright position on its base. Because dentifrice material is deposited directly onto the top surface of the brush instead of being applied from the bottom of the brush, it is easy to clean. The brush and the cartridge can be replaced without replacing the entire device thus providing an economic benefit. The application of a controlled quantity of dentifrice material to the brush surface and the need for the use of only one hand to operate the device are beneficial to the visually and physically handicapped.

The invention has been described in detail with reference to a preferred embodiment thereof. However, it will be understood that variations and modifications can be effected within the spirit and scope of the invention. For example, applicator 6 can be stationary rather than movable. If desired, handles 8 and 10 can be mechanically linked so that the movement of one causes movement of the other. Moreover, disc 58 can be used in conjunction with cartridge walls which do not contain grooves. Also, flexible, radially extending fingers 60 can be replaced by a flexible annular flange which is positioned along the circumference of disc 58.

For purposes of this application, the width or maximum dimension of the cartridge is the length of the longest chord which passes through the center of a cross-sectional plane of the cartridge. The width or maximum dimension of the disc is defined as the length of the longest finger to finger chord which passes through the center of the disc.

Other principles employed for the design and function of the dentifrice dispensing toothbrush of this invention are readily transferable to other useful applications.

I claim:

1. A dentifrice dispensing toothbrush comprising:

a. a housing;

b. a reservoir situated within the housing for storing dentifrice material;

c. a brush which contains a head member and a set of bristles having their bottom end portions attached to the head member and their top end portions unattached so as to collectively provide a brush surface for supporting dentifrice material, said brush being releasably attached to the housing;

d. pumping means attached to the reservoir and comprising a piston for applying a pumping force to the dentifrice material to cause a controlled quantity of it to flow from the reservoir, and a plunger for driving the piston wherein one end of the plunger is in communication with the brush head member when a pumping force is applied;

e. a channel situated within the housing for the passage of the controlled quantity of dentifrice material as it is pumped from the reservoir, said channel having a first opening for receiving dentifrice material as it is pumped from the reservoir into the channel and a second opening for discharging dentifrice material from the channel; and f. a movable applicator comprising a tube attached to the housing, said tube having first and second openings, such that when the movable applicator is positioned in a depositing relationship with the brush surface, dentifrice material is permitted to be pumped from the reservoir, through the channel, into the applicator through its first opening, and to be deposited onto the brush surface upon discharge from the applicator through its second opening, and such that when the movable applicator is its second opening, and such that when the movable applicator is positioned in a non-depositing relationship with the brush surface, dentifrice material is prevented from being pumped from the reservoir.

2. The dentifrice dispensing toothbrush described in claim 1 wherein the first opening of the movable applicator is aligned with the second opening of the channel when the applicator is in a depositing relationship with the brush surface and wherein the first opening of the applicator is not aligned with the second opening of the channel when the applicator is in a non-depositing relationship with the brush surface.

3. The dentifrice dispensing toothbrush described in claim 1 wherein a spring is attached to the piston to enable the piston to return to the same position after each application of the pumping force.

4. The dentifrice dispensing toothbrush described in claim 1 wherein the piston includes a stem and a head and contains an orifice which extends longitudinally through the piston head and piston stem so as to provide an opening for the passage of dentifrice material when it is pumped from the reservoir.

5. The dentifrice dispensing toothbrush described in claim 1 wherein the reservoir includes a removable cartridge for storing dentifrice material.

6. The dentifrice dispensing toothbrush described in claim 5 wherein the housing includes a port for viewing the dentifrice material in the removable cartridge and for venting air from the housing when the removable cartridge is inserted in the housing.

7. The dentifrice dispensing toothbrush described in claim 1 wherein the brush surface is comprised of long bristles and short bristles, said long bristles arranged in a U-shaped configuration such that the short bristles are situated at the center and at the end of the brush surface farthest from the housing and the long bristles are situated along the remaining perimeter of the brush surface.

8. The dentifrice dispensing toothbrush described in claim 1 wherein the brush is releasably attached to the housing by a threaded coupling for fastening.

9. A dentifrice dispensing toothbrush comprising:

a. a housing;

b. a reservoir situated within the housing;

c. a removable cartridge situated within the reservoir for storing dentifrice material, said removable cartridge comprising a hollow cylinder having one flared end and one unflared end, a disc having a shape which is conformable to the shape of the unflared base and being slidably mounted within the hollow cylinder, and retention tabs to prevent the movement of the disc beyond the tabs;

d. a brush which contains a head member and a set of bristles having their bottom end portions attached to the head member and their top end portions unattached so as to collectively provide a brush surface for supporting dentifrice material, said brush being releasably attached to the housing;

e. pumping means attached to the reservoir to cause a controlled quantity of dentifrice material to flow from the removable cartridge;

f. a channel situated within the housing for the passage of the controlled quantity of dentifrice material as it is pumped from the removable cartridge, said channel having a first opening for receiving dentifrice material as it is pumped from the removal cartridge into the channel and a second opening for discharging dentifrice material from the channel; and g. a movable applicator comprising a tube attached to the housing, said tube having first and second openings, such that when the movable applicator is positioned in a depositing relationship with the brush surface, dentifrice material is permitted to be pumped from the removable cartridge, through the channel, into the applicator through its first opening, and to be deposited onto the brush surface upon discharge from the applicator through its second opening, and such that when the movable applicator is positioned in a non-depositing relationship with the brush surface, dentifrice material is prevented from being pumped from the removable cartridge.

10. A dentifrice dispensing toothbrush comprising:

a. a housing;

b. a reservoir situated within the housing;

c. a removable cartridge situated within the reservoir for storing dentifrice material, said removable cartridge comprising a hollow cylinder having a grooved inner wall surface and a disc having a shape which is conformable to the shape of the cylinder base and being slidably mounted within the cylinder, said disc having a plurality of flexible, radially extending fingers positioned on the circumference of the disc, the width of the disc including the flexible, radially extending fingers being greater than the internal width of the cylinder whereby the ends of the flexible radially extending fingers are matable in the grooves of the inner wall surface;

d. a brush which contains a head member and a set of bristles having their bottom end portions attached to the head member and their top end portions unattached so as to collectively provide a brush surface for supporting dentifrice material, said brush being releasably attached to the housing;

e. pumping means attached to the reservoir to cause a controlled quantity of dentifrice material to flow from the removable cartridge;

f. a channel situated within the housing for the passage of the controlled quantity of dentifrice material as it is pumped from the removable cartridge, said channel having a first opening for receiving dentifrice material as it is pumped from the removable cartridge, said channel having a first opening for receiving dentifrice material as it is pumped from the removable cartridge into the channel and a second opening for discharging dentifrice material from the channel; and g. a movable applicator comprising a tube attached to the housing, said tube having first and second openings, such that when the movable applicator is positioned in a depositing relationship with the brush surface, dentifrice material is permitted to be pumped from the removable cartridge, through the channel, into the applicator through its first opening, and to be deposited onto the brush surface upon discharge from the applicator through its second opening, and such that when the movable applicator is positioned in a non-depositing relationship with the brush surface, dentifrice material is prevented from being pumped from the removable cartridge.

* * * * *